United States Patent [19]

Jackson

[11] Patent Number: 4,462,372

[45] Date of Patent: Jul. 31, 1984

[54] FUEL INJECTION SYSTEM

[76] Inventor: Maurus E. Jackson, 1905 Victory Blvd., Glendale, Calif. 91201

[21] Appl. No.: 431,767

[22] Filed: Sep. 30, 1982

[51] Int. Cl.[3] ..... F02M 39/00

[52] U.S. Cl. ..... 123/452; 123/462; 123/459; 137/625.47

[58] Field of Search ..... 123/452, 455, 505, 510, 123/462, 459; 251/209; 137/625.47, 876

[56] References Cited

U.S. PATENT DOCUMENTS

| | | | |
|---|---|---|---|
| 1,493,133 | 5/1924 | Sykora | 137/625.47 |
| 1,774,685 | 9/1930 | Vickers | 137/652.47 |
| 2,895,463 | 7/1959 | Powell et al. | 123/502 |
| 2,901,031 | 8/1959 | Powell et al. | 123/452 |
| 2,902,016 | 9/1959 | Powell et al. | 123/462 |
| 3,129,644 | 4/1964 | Andersen | 137/625.47 |
| 3,473,523 | 10/1969 | Hilborn | 123/446 |
| 3,966,119 | 6/1976 | Harter | 251/209 |

*Primary Examiner*—Magdalen Y. C. Moy
*Attorney, Agent, or Firm*—Sellers and Brace

[57] ABSTRACT

Disclosed is a fuel injection system particularly useful on supercharged boat and vehicle drag racing engines which functions to provide a positively controlled uniform fuel/air ratio proportional to engine speed from idle through maximum engine horsepower operation. The system utilizes an engine-driven positive displacement pump supplying pressurized fuel to calibrated injection nozzles via a unique driver-controlled fuel metering valve. This valve has idle and full throttle positions for vehicle racing, but idle, partial and full throttle positions for boat racing. In each application, excess fuel entering a rotary metering valve is returned to the source via continuously open valveless passages and, upon initiation of acceleration, total fuel requirements are supplied to the engine instantly and without delay in a precisely controlled fuel/air ratio. During the initial phase of engine acceleration, the rate of fuel flow to the injectors is inversely proportional to the rate of return of excess fuel to its source and fuel pressure increases proportionately to the square of the increase in engine speed. During deceleration, excess fuel is automatically dumped to its source by the metering valve to safeguard against a pressure rise at the fuel pump outlet and the attendant highly destructive consequences.

22 Claims, 13 Drawing Figures

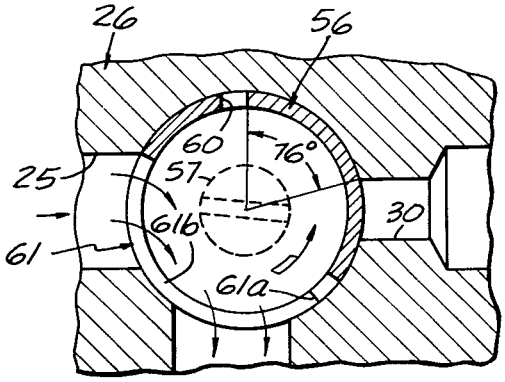
FIG. 4.
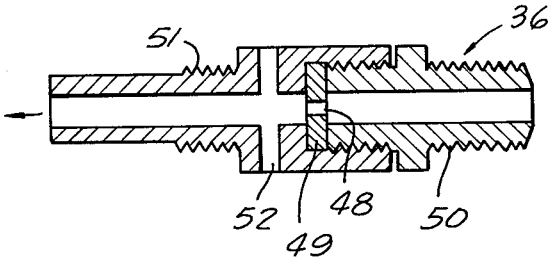
FIG. 6.
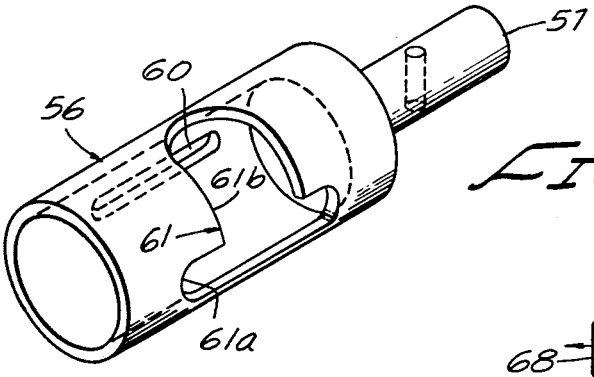
FIG. 5.
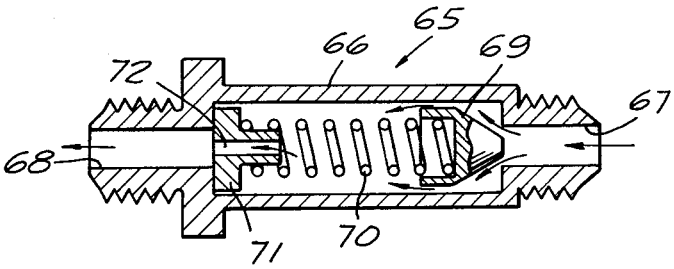
FIG. 7.
FIG. 8. IDLE POSITION
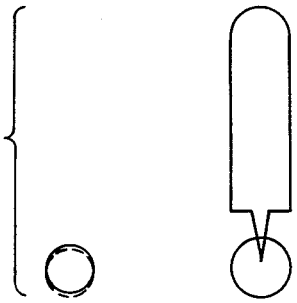
FIG. 9. FULL THROTTLE POSITION
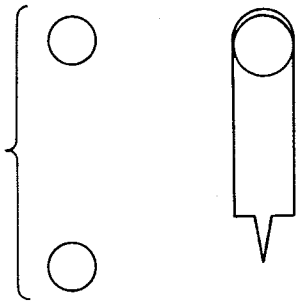
PRIOR ART

FUEL INJECTION SYSTEM

This invention relates to fuel injection systems, and more particularly to a unique fuel injection system particularly suitable for use to power boat and vehicle drag racing engines operable at full throttle during racing.

BACKGROUND OF THE INVENTION

Designers of fuel systems for engines employed in boat and vehicle drag racing competition have been confronted with numerous vexatious problems not heretofore satisfactorily resolved. Currently, such engines are supercharged and utilise special and expensive fuels, such as nitromethane. Drag vehicle engines go substantially instantly from idle to full throttle operation and as quickly back to idle at race termination, whereas drag boat engines go from idle to a steady approach speed and then substantially instantly to full throttle and then instantly back to idle at race termination.

Heretofore, efforts to provide pressurized fuel injection systems meeting the exacting needs of such abrupt changes in engine operation involve many unsolved problems. For example, the fuel pumps used in such systems typically have a service life of only one to several races due to the severe operating conditions to which they are subjected. No satisfactory solution has been found for supplying sufficient fuel to provide the correct fuel/air ratio during the initial phase of acceleration, other than spring loaded check valves. The high pressure check valves employed for this purpose are the main cause of short pump life. Additionally no solution has been found for protecting the fuel pump from destructive high pressures developed upon abrupt closure of the fuel metering valve at race end.

Most prior proposals have endeavoured to use various arrangements of spring loaded check valves to control pressure in the fuel delivery ducting and/or in ducting venting excess fuel back to the fuel source. These proposals are subject to a variety of disadvantages including serious damage to components such as the fuel pump and the engine. My own efforts to solve these problems endeavoured to avoid spring biased check valves in the excess fuel venting ducting but were subject to the serious delay and tardiness in controlling excess fuel when initiating acceleration and particularly during deceleration. Smooth, rapid and highly efficient acceleration is dependent on substantially instantaneous cutoff of excess fuel and the immediate supply of 100% of engine acceleration fuel requirements. Likewise, it is critically essential to vent excess fuel substantially instantly upon release of the acceleration pedal at termination of the race as otherwise the resultant high increase in fuel pressure will seriously damage both the fuel pump and the engine. The present invention avoids these serious disadvantages using a metering valve having unique porting and operating characteristics.

The U.S. Pat. No. 3,473,523 to Hilborn recognises the presence of certain of the aforementioned problems and proposes techniques for resolving them. For example, he recognises the need for compensating for the delay in supplying adequate fuel during the initial phase of acceleration. To meet this need he provides normally closed check valves in the excess fuel return line. These valves are set to open in time delayed sequence at initiation of acceleration. This results in an excessively rich mixture, wastage of costly fuel, and in very rough, inefficient and harmful engine operation. He also attempts to protect the hot engine from the destructive effects of excessively rich fuel typically occuring during deceleration by providing a check valve controlled bypass for excess fuel set to open as his metering valve approaches its idle position. Unfortunately, the injector pump is often ruined by excessive fuel pressure rise inherently provided by this expedient.

Another serious shortcoming of fuel metering valves as heretofore proposed for drag engine fuel systems is the attempt to control fuel flow through one or more circular ports by a rotary valve member. It is not possible when using such valve structures to vary the fuel/air ratio in proportion to changes in engine speed from idle speed to instant throttle opening.

SUMMARY OF THE INVENTION

The foregoing and other shortcomings and disadvantages characterizing the fuel systems heretofore proposed for use on supercharged drag engines are avoided by the present invention. A positive displacement pump of adequate capacity driven by the engine delivers pressurized fuel to a unique metering valve having a single moving member operatively linked to the accelerator pedal and to the butterfly throttle valve. Both the valve body and the movable member have specially designed noncircular ports cooperating with a rectalinear throttle valve to provide instantly and after a movement of not in excess of 9° a precise fuel/air mixture proportional to engine speed.

By way of example, at an engine idling speed of 2,000 rpm, 80% of the fuel is returned to the supply and 20% is delivered to the nozzles and a proper fuel/air mixture is provided by the throttle open by approximately 1.6°. At race start, the interlinked throttle and metering valves are opened as suddenly and abruptly as possible. Instantly, additional fuel is supplied to the engine via unrestricted passages in a continuously maintained highly efficient fuel/air ratio. The metering valve cuts off the flow of excess fuel in a small fraction of its full movement and continues to meter fuel linearly via the main fuel port through the remaining major portion of its opening movement. During acceleration all engine fuel flows without impediment of any kind into the supercharger inlet. At race end, the metering valve closes equally abruptly and substantially instantaneously thereby instantaneously reopening its excess fuel venting port to prevent any increase of consequence in the fuel pressure and avoiding an enriched fuel mixture so harmful to the very hot engine.

In view of the foregoing it is a primary object of the invention to provide a unique fuel injection system for use on engines employed to power drag racing boats and vehicles.

Another object of the invention is the provision of a fuel injection system for vehicle drag racing engines having a fuel metering valve linked to a butterfly air control valve wherein the metering valve is constructed to close its excess fuel venting port during valve rotation not in excess of 9° during the initial phase of acceleration with the air throttle valve open approximately 1.6° at the beginning of engine acceleration.

Another object of the invention is the provision of a fuel injection system for a boat racing engine having a fuel metering valve linked to a butterfly air control valve wherein the metering valve is constructed to close its excess fuel venting port during rotation of about 23° from its engine idle position and wherein the throttle is open about 15° at the zero race-time position.

Another object of the invention is the provision of a pressurized fuel injection system for a race vehicle having a fuel metering valve equipped with non-circular fuel flow control ports including an elongated slot for an excess fuel port and a T-shaped port to control fuel flow to the injection nozzles.

Another object of the invention is the provision of a fuel injection system wherein, during acceleration, the rate of fuel flow to the injectors is inversely proportional to the rate of return of excess fuel to its source, and wherein, during deceleration, excess fuel is automatically and substantially instantaneously dumped to safeguard against harmful pressure rise at the fuel pump outlet and a harmful rich fuel air mixture to the engine.

Another object of the invention is the provision of a metering valve for a fuel injection system having a movable member operable during the initial phase of acceleration to vary the rate of fuel flow to the engine in inverse proportion to the rate of return of excess fuel to its source.

Another object of the invention is the provision of an engine fuel injection system equipped with a positive displacement pump and having means for automatically dumping excess fuel to its source upon deceleration of the engine from high speed operation.

Another object of the invention is the provision of a fuel injection system for a drag racing engine operable to supply additional fuel to the engine instantly upon initiation of acceleration and in an amount directly proportional to increasing air supply and engine speed.

Another object of the invention is the provision of a fuel injection system for an engine having a fuel metering valve equipped with non-circular excess fuel and main fuel flow ports cooperating with a respective non-circular outlet flow passage.

These and other more specific objects will appear upon reading the following specification and claims and upon considering in connection therewith the attached drawing to which they relate.

Referring now to the drawing in which a preferred embodiment of the invention is illustrated:

FIG. 4 is a fragmentary view similar to FIG. 3 but showing the metering valve fully open for maximum engine speed;

FIG. 5 is a perspective view of the single rotary component of the metering valve;

FIG. 6 is a cross sectional view of one of the injector nozzles;

FIG. 7 is a cross sectional view through the pressure regulator valve;

FIG. 8 is a diagrammatic view showing my prior art metering valve ports in engine idle position;

FIG. 9 is a diagrammatic view showing my same prior art metering valve ports in the full throttle engine operating position;

Figure 1:
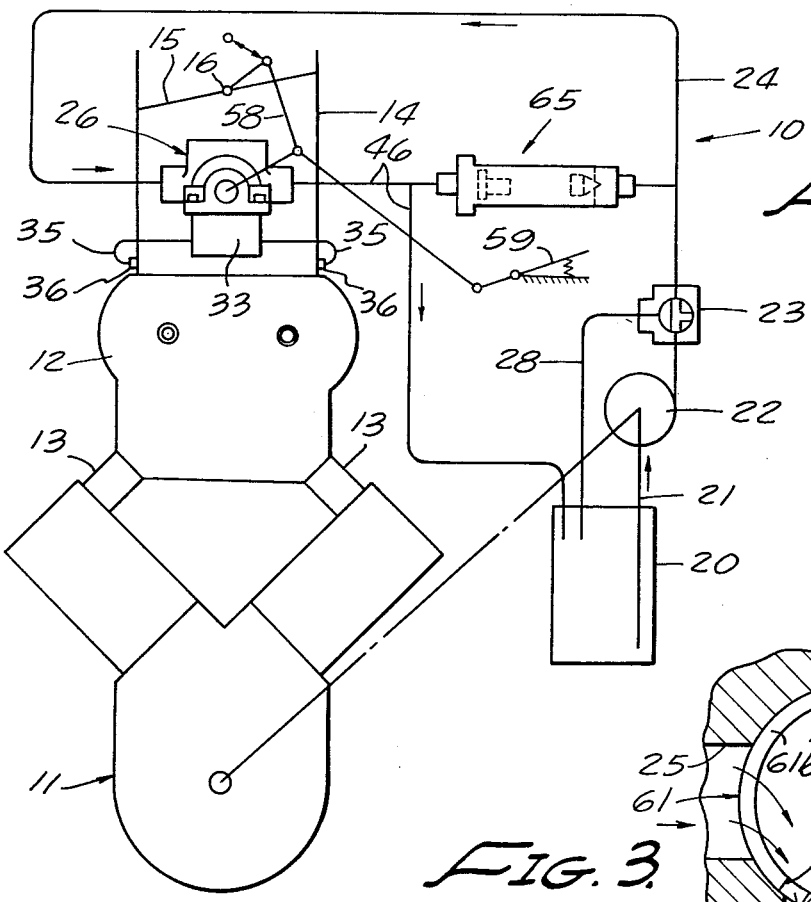
FIG. 1 is a schematic view of an illustrative embodiment of the invention fuel injection system connected to a supercharged drag race engine.

Referring initially to FIG. 1, there is shown an illustrative embodiment of the fuel injection system, designated generally 10, installed on a vehicle drag racing engine 11. The engine is equipped with a supercharger 12 extending substantially the full length of the intake manifolds 13 with its inlet connected to an air supply duct 14. This duct is also rectangular in cross section and extends substantially the full length of the supercharger. A butterfly throttle valve 15 is mounted on a shaft 16 and rotates counter clockwise from the 1.6° open idle position shown to an upright position under the control of the operator's spring-biased accelerator pedal 59.

A fuel supply of a type suitable for drag racing, such as nitromethane, or other well known racing fuels, is stored in a tank 20. This fuel is supplied through duct 21 to the inlet of a positive displacement pump 22 driven from the engine cam shaft, discharges through a 3-way valve 23 and a duct 24 into the inlet passage 25 of a novel metering valve, designated generally 26. As will be readily apparent from FIG. 1, 3-way valve 23 can be rotated to a position cutting off all fuel flow to the injector and returning all fuel flow to tank 20 via duct 28.

Figure 2:
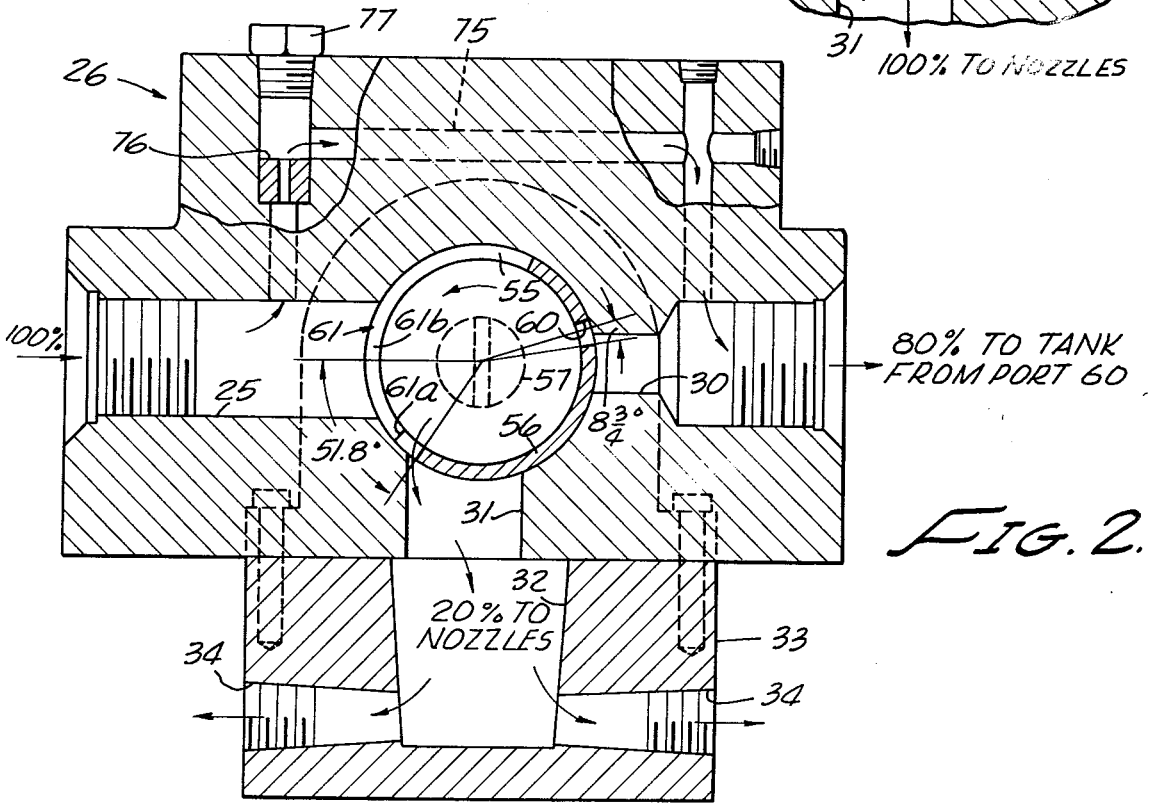
FIG. 2 is a vertical cross sectional view on an enlarged scale through the metering valve of a drag race vehicle in its idle operating position.

Metering valve 26 has two outlet passages of rectangular cross section, the first being a rectangular excess fuel passage 30 on the right hand side of FIG. 2, and the second being a rectangular main fuel outlet passage 31. The latter passage opens into a central passage 32 of a manifold block 33 secured to the underside of the metering valve and having separate fuel outlets 34 connected by unrestricted ducts 35 discharging into the opposite sides of the supercharger inlet via calibrated nozzle assemblies designated generally 36 and the details of which are shown in FIG. 6.

The fuel injection nozzles 36 are constructed as shown in FIG. 6. Each has a calibrated injector port 48 formed in a disc 49 clamped between a pair of tubular fittings 50, 51 mounted in the supercharger inlet. The fuel outlet fitting 51 is preferably provided with one or more atmospheric air inlets 52.

The remaining component of the fuel injection system is the automatic pressure regulator 65 of conventional design installed between duct 24 and the excess fuel return duct 46, the details being best shown in FIG. 7. The purpose of this regulator is to bypass increasing small amounts of fuel to the fuel source beginning in the area of maximum engine power output or torque typically occuring at about 6,500 rpm. Regulator 65 has a tubular housing 66 enclosing a valve 69 normally held seated over the outlet end of inlet 67 by a spring 70. The other end of this spring is seated against an outlet flow choking member 71 having a bore 72 discharging into duct 46 via outlet passage 68.

THE FUEL METERING VALVE

The fuel metering valve employed for vehicle drag racing will now be described with particular reference to FIGS. 2 through 5. The main body of metering valve 26 has a cylindrical bore or well opening through one sidewall thereof rotatably supporting a single tubular or cupshaped valve 56 having an operating stem 57 (FIG. 5) extending through the wall of the valve housing. This stem is connected by linkage 58 (FIG. 1) to the crank arm of throttle valve 15 and to the conventional spring-biased accelerator pedal 59. As is best shown in FIG. 5, the sidewall of valve 56 is provided with a slotlike fuel venting port 60 and with a T-shaped main fuel port 61. The latter includes a slotlike T-head portion **61*a* slightly larger than but corresponding in shape with venting port 60 and a much larger T-stem portion 61*b* lying generally at right angles to its T-head portion 61*a***.

The dimensions of the venting port 60, main fuel port 61, the flow passages associated therewith, their angular relationships to one another and the discharge areas of the fuel nozzles 36 are critically important to top engine performance. The venting port outlet passage 30 and the main fuel outlet passage 31 are of rectangular construction and the position of one longer sidewall of each relative to an associated edge of ports 60 and **61*a* is important. In a prototype of a metering valve found to provide highly satisfactory results, venting port 60 had a length of 0.520 inches and a width of 0.125 and its outlet passage 30 had a length of 0.680 inches and a width of 0.250 inches. The T-shaped main fuel port 61 had a T-head portion 61*a* 0.820 inches long and 0.250 inches wide opening into a T-stem portion 61*b* 0.500 inches wide and 1.220 inches long. Both the venting port 60 and the T-head portion 61*a* of port 61 had semicircular ends to simplify their manufacture by milling cutters. Venting port 60 was parallel to the T-head portion 61*a* of port 61 and so positioned relative to one another that the venting port would be fully closed upon 8.75° counterclockwise rotation of valve 56 and the lowermost edge of the T-head portion 61*a* would be open by about 0.005 inches and found adequate to supply engine idling fuel requirements of about 2,000 rpm. Under these conditions port 60 vents about 80% of the fuel entering port 61 back to the fuel tank, and the slightly open portion of port 61*a* passes 20% of the fuel to the fuel injection nozzles 36**.

Figure 3:
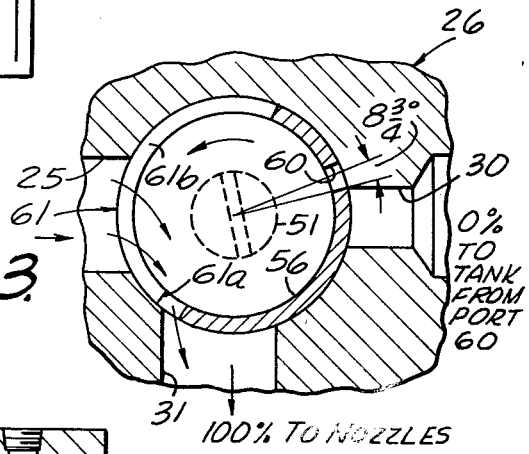
FIG. 3 is a fragmentary view similar to FIG. 2, but showing the valve rotated 8.75°, to the closed position of the venting port at the end of the initial accelerating phase.

Referring now to FIG. 3, it will be apparent that counterclockwise rotation of valve 56 through only $8\frac{3}{4}$° will cut off all flow of excess fuel through venting port 60 and will supply 100% of the fuel entering valve 56 directly to the fuel injector nozzles 36. It will be noted that T-head port **61*a* is longer than the width of the T-stem portion 61*b*. This larger size assures an adequate flow of pressurized fuel to the injection nozzles during the initial stage of rapid acceleration and overcome flow loss factors attending fuel flow around the bend between passages 25 and 31 as well as through the metering port 61 (FIG. 1). Portion 61*b* of the main fuel port 61 will cooperate with outlet passage 31 in metering fuel to the engine in direct proportion to the larger volume of air permitted to flow by the partial opening of throttle valve 15 by linkage 58 and its operating connection to metering valve 56**.

The metering valve preferably includes a bypass 75 interconnecting fuel inlet passage 25 and the excess fuel return passage 30. Bypass 75 is equipped with orifice member 76 installable upon removal of the plug 77. The purpose of this orifice-equipped bypass 75 is to compensate for variations in the excess output of different fuel pumps 22 even of the same type and manufacturing source. This is accomplished by installing a disc 76 having an orifice of the proper size for use with a particular fuel pump and thereby enabling the metering valve, when in idle position shown in FIG. 2, to vent 80% of the fuel entering valve 56 through vent port 60 and to pass the other 20% of the fuel through port **61*a*** to the engine to satisfy engine idling requirements. Discs of appropriate orifice size are also installable to compensate for fuel mixtures of different compositions such as larger or smaller percentages of exotic fuels and gasoline.

The construction and operating characteristics of the above described fuel metering valve deviate in critically important respects from my own prior metering valve which differs from that shown in FIGS. 1–5 as respects the ports in the movable valve 56 and as respects the respective outlet flow passages associated therewith. These details are illustrated in FIGS. 8 and 9 wherein the same ports and passages of the two metering valves are designated by the same reference characters but distinguished by the addition of a prime in FIGS. 8 and 9.

It will be noted that, in my prior metering valve, the excess fuel port 60 in the rotary valve member as well as its outlet fuel passage 30′ are both circular and have a diameter adequate to handle maximum engine fuel requirements as, for example, 250 mils when using nitromethane. This diameter requires a minimum rotation of the valve of 28° to close the excess fuel port 60, or more than four times the rotary movement required to close the excess fuel port 60 in the embodiment shown in FIGS. 1 to 5. In use, it was found that this earlier mode of metering provided very unsatisfactory engine performance during the initial phase of accelerator due to the time required to close the venting port and the delay in providing the required fuel flow for maximum engine performance.

The main fuel port 61′ of my prior metering valve was a long slot having a width of about 375 mils formed with a narrow V-notch opening centrally through one end wall. In the engine idle position of the rotary valve member, the notch was in partial registry with the circular outlet passage 31′ having a diameter of about 375 mils. The rotary valve member so ported was rotated 85° abruptly, in accordance with drag racing practice, from the FIG. 8 idle position to the FIG. 9 full power position, the first 28° of this movement being required to close the venting port 60′, or more than four times the movement required in my greatly superior design illustrated in FIGS. 1–5. During this 28° movement the fuel pressure increased slowly and portions of the fuel needed to support efficient and effective rapid acceleration was vented back to the fuel source. In consequence engine performance was extremely sluggish and highly unsatisfactory for its only design purpose, namely, quarter mile competitive drag racing.

OPERATION OF FUEL SYSTEM FOR DRAG RACING VEHICLE

The operation of my improved drag vehicle fuel system shown in FIGS. 1–5 will be readily apparent from the foregoing detailed description of its components. Customarily, nitromethane is the fuel employed, the engine volumetric requirements for which are approximately seven times greater than when using gasoline. The engine is started in the usual fashion and idled at approximately 2,000 rpm for warm up and other preliminaries. At that time the spring biased accelerator pedal 59, holds the throttle valve 15 open at an angle of approximately 1.6 from its fully seated position which is 3.4° from a horizontal plane. The accelerator pedal spring also holds valve member 56 of the metering valve in its idling position shown in FIG. 2 with venting port open 8.75° and main fuel port 61*a* open 0.005 inches. During idling, some excess fuel wil be escaping back to the fuel tank through the U-shaped passage 75 overlying valve member 56 and containing the orifice member 76. This by pass is useful because fuel pumps typically have an output in excess of engine requirements, a condition readily corrected by the installation of a by pass orifice member 76 of proper size in passage 75 of the metering valve.

During engine idling, the slot portion 61*a* of the T-shaped main fuel port 61 supplies 20% of the fuel to the injector nozzles 36 distributed along the opposite sides of the inlet to supercharger 23 whereas 80% of the fuel entering valve member 56 escapes through venting port 60 and returns to the tank via duct 46. In accordance with conventional practice, the fuel nozzles have a combined port area which is less than the open portion of port 61*a* during acceleration of the engine.

At the start of the race the driver suddenly depresses the accelerator pedal to its maximum open position thereby abruptly opening throttle 15 as well as the remainder of portion 61*a* and that portion 61*b* of the main fuel port 61 in registry with its outlet passages 31. As has been pointed out, the fuel flow to the engine increases instantly in volume and in pressure and issues instantly from injector nozzles 36 into the increasing airflow entering supercharger 12. This increased fuel flow occurs in the requisite volume to provide a uniform efficient flow through the unrestricted fuel flow ducts 35 leading to each of the injector nozzles 36. The amount of fuel vented through port 60 into the rectangular escape passage 30 is cut off in inverse ratio to the increased flow taking place through the rectangular port 61*a* into the rectangular flow passage 31 leading to the injector nozzles. Fuel flow thereby provided takes place instantaneously and in direct proportion to the increased airflow provided by the supercharger. After counterclockwise rotation of valve 56 by about 8.75°, venting port 60 is fully closed and the further rotation of valve 56 supplies fuel to the injectors via portions 61*a* and 61*b* of supply port 61.

At the end of the drag race the operator abruptly releases the accelerator pedal whereupon its return spring abruptly closes throttle 15 and restores metering valve member 56 to the idle position shown in FIG. 2. As the almost instantly closing metering valve 56 approaches engine idling position, venting port 60 opens to dump fuel back to the tank with the result that during acceleration, the fuel pressure does not exceed 140 psi, a value only slightly higher than the maximum pressure prevailing during racing. In fact, the return of the metering valve to idling is so rapid that this fuel dumping cycle occurs substantially instantly upon release of the accelerator pedal. This action is extremely important because avoiding exceedingly high and harmful fluid pressures of 300 to 350 psi at the pump outlet heretofore typically occuring in racing engine injector systems during deceleration.

DRAG BOAT FUEL INJECTION SYSTEMS

Referring to FIGS. 10 through 13, a slightly modified version of the fuel metering valve is disclosed as designed for use in drag boat racing. Since only minor changes in the valve are involved, all parts are designated by the same characters as used in FIGS. 1–8 but distinguished by the addition of a prime. The modifications are necessary because drag boats employ a short run between idle engine operation and the race starting line to accelerate the engines from the 2,000 rpm idle condition to the approximate 3,500 rpm at the steady state rolling start position as the boat crosses the starting line.

The main body of the metering valve 26' is the same as in FIGS. 1–8 but the valve member 56' has modified porting. This modification is the best illustrated diagrammatically along the lefthand side of FIGS. 10–13. Both venting port 60' and the main supply port 61' are of T-shape and register only with rectilinear portions of their respective outlet passage 30' and 31'. In a highly successful prototype of metering valve 26' as designed for drag boat racing, ports 60' and 61' and the outlet passages 30' and 31' associated therewith had the following dimensions and specifications.

Venting port 60' had a T-head portion 0.368 inches long and 0.078 inches wide opening into a T-stem portion 0.105 inches wide and 0.147 inches long. This port was registerable with an outlet passage having semi-circular ends, a total length of 0.680 inches and a width of 0.250 inches.

The main fuel port 61' had a T-head portion extending 0.500 inches axially of valve 56' and 0.800 inches circumferentially of the valve. This port rotates past the rectilinear outlet passage 31' having semi-circular ends, a length of 1.000 inch and a width of 0.375 inches. Valve 56' provided with ports 60' and 61' rotates 85° between the engine idle position shown in FIG. 10 and the full throttle position shown in FIG. 13. The angular movements of these ports relative to the outlet passages 30', 31' in progressing from idle through standby, the beginning of maximum acceleration and full open throttle is indicated in degrees in FIGS. 10–13.

OPERATION OF DRAG BOAT FUEL SYSTEM

Figure 10:
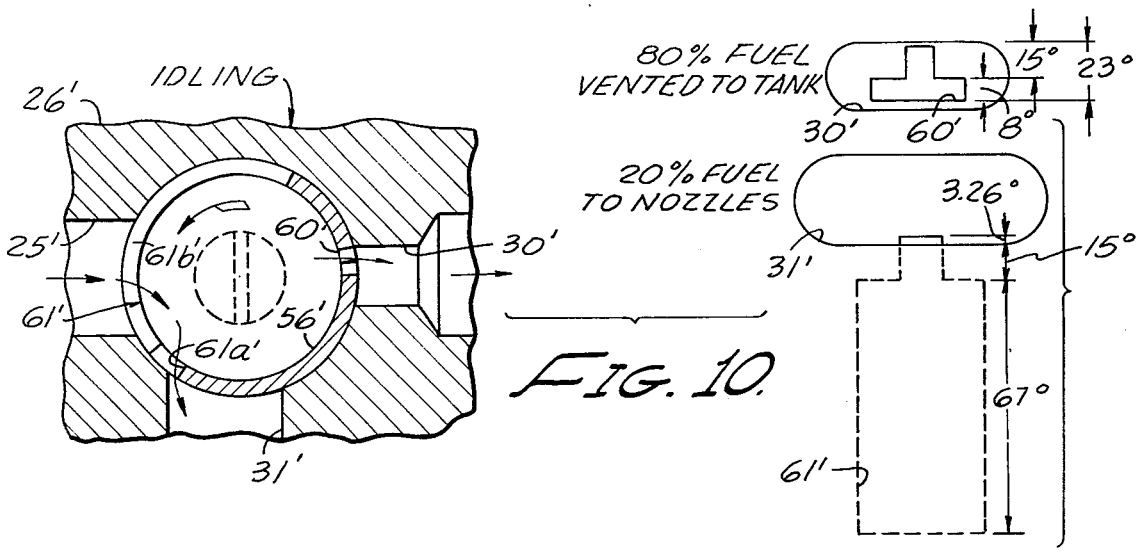
FIG. 10 is a fragmentary cross sectional view through the rotary member of the fuel metering valve as designed for boat drag racing and showing the position of the valve in engine idling position. Shown to the right of the valve proper are cross sectional view representations of the excess fuel passage and of the main fuel flow passage during engine idling.

The operation of the drag boat fuel injection system shown in FIGS. 10–13 differs in no major respect from that described for the drag car fuel injection system of FIGS. 1–5 except for the provisions made to bring engine speed up to a steady state rolling start as it crosses the starting line with the engine operating at approximately 3,500 rmp. Initially the engine idles at 2,000 rpm and the valve is positioned as shown in FIG. 10 with 80% of the fuel being vented to the tank through the wide open venting port 60' and 20% of the fuel flowing through the slightly open main port 61' directly to the injection nozzles, this flow taking place through the tip of the T-stem portion of port 61*a'* which, as shown in FIG. 10 is open about 3.26°.

Figure 11:
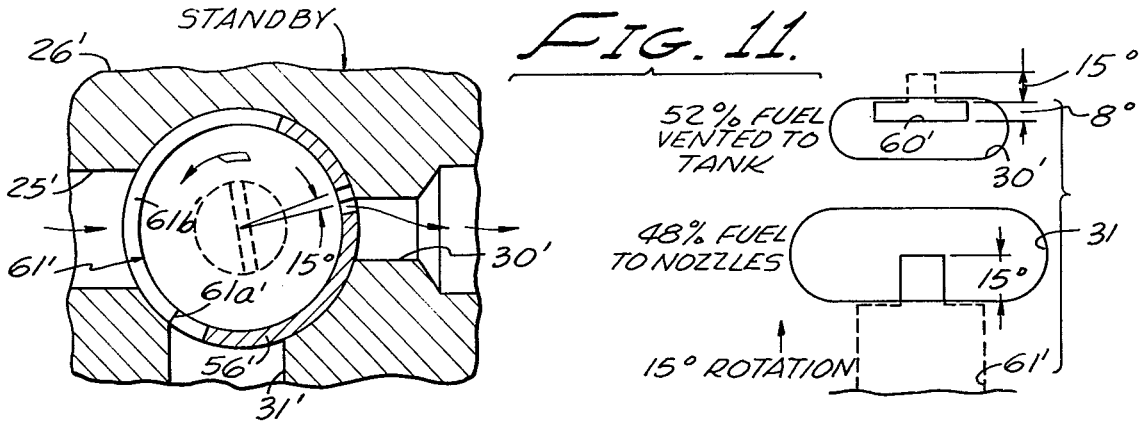
FIG. 11 is a cross sectional view along with diagrammatic views similar to FIG. 10 showing the boat racing metering valve opened sufficiently to advance the boat to the starting line at a designated starting speed.
Figure 12:
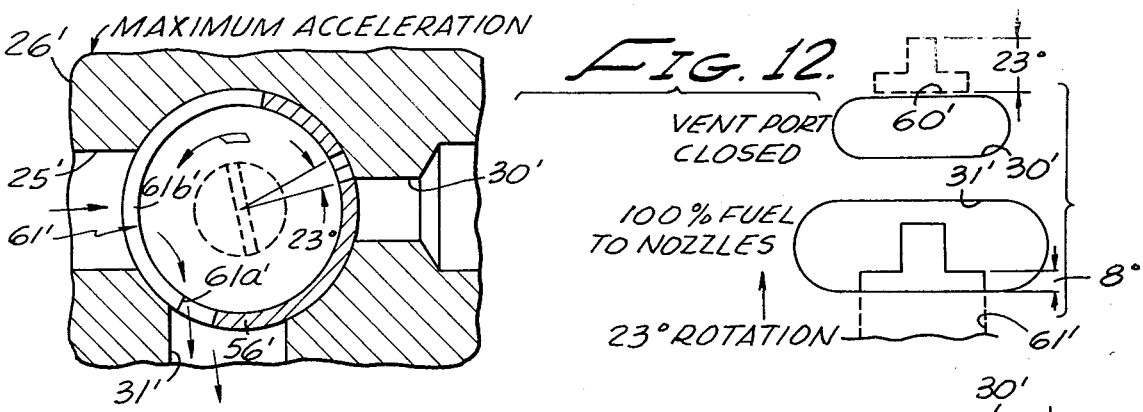
FIG. 12 is a cross sectional view along with diagrammatic views similar to FIG. 10 but showing the boat racing valve at the end of the initial acceleration phase upon departure from the starting line and with the excess fuel port fully closed.
Figure 13:
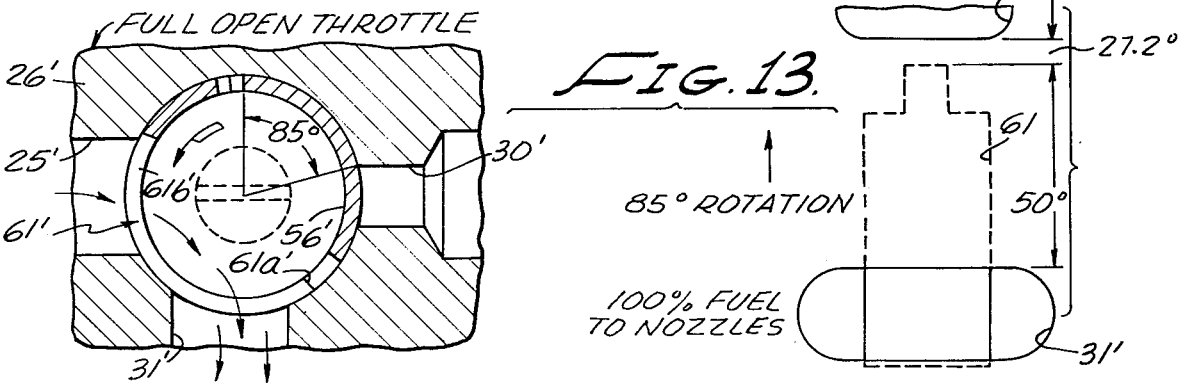
FIG. 13 is a cross sectional view along with diagrammatic views similar to FIG. 10 but showing the same valve in full open throttle position.

During the steady state rolling start the accelerator is abruptly depressed to open the throttle valve from its 1.6° open idle position and to open the throttle valve and valve 56' 15° from the idle position, the ports 60' and 61' then being positioned as shown in FIG. 11. This closes off the T-stem of venting port 60' and opens the remainder of the T-stem portion of the fuel supply port 61' thereby increasing the supply of fuel to the injectors to 48% and reducing the vented fuel to 52%. Typically the engine will then be operating at about 3,500 rpm as it crosses the race starting line. At that instant, the operator abruptly and fully depresses the accelerator as rapidly as possible. The first 8° of rotation during this initial phase of further acceleration fully closes the venting port 60' and increases the open portion of port 61' in a manner highly effective in extremely rapid acceleration of the engine. An instant later the valve is fully open at a position 85° from its engine idling position.

To be noted is the fact that, in all positions of valve 56' from idling to full open throttle, the fuel/air ratio remains at an optimum valve for most efficient engine operation.

While the particular fuel injection system for boat and vehicle drag racing engines herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A continuous flow fuel injection system for use on a racing engine equipped with accelerator controlled butterfly throttle valve means connected to an inlet of a supercharger discharging into the engine intake manifold, said fuel injection system being characterized by having in combination:

a positive displacement fuel pump adapted to be driven by the engine and having a capacity at least equal to maximum engine needs;

fuel metering valve means having an inlet connected to an outlet of said pump and having a non-circular main fuel outlet passage discharging into air flowing to the engine intake manifold and a non-circular excess fuel passageway connected to an fuel source by continuously open unrestricted duct means;

a rotary valve mounted in said metering valve means operatively connected to said throttle valve means and having a non-circular main fuel port for controlling fuel flow between said fuel inlet and said main fuel outlet passage, and having a non-circular venting port operatively associated with said excess fuel passage, said rotary valve being operable to vent excess fuel to the fuel source at the starting line of a race and to close after not in excess of 9° rotation of said valve toward the fully open throttle position thereof as the engine accelerates; and said valve being operable upon release of said accelerator to rotate abruptly in the reverse direction to a position supplying fuel for engine idling while opening said venting port to vent excess fuel to the fuel source and avoid a harmful pressure condition on the outlet side of said fuel pump.

2. A fuel injection system as defined in claim 1 characterized in that said venting port includes a slot-like portion extending axially of said rotary valve.

3. A fuel injection system as defined in claim 2 characterized in that said fuel passages and said valve ports have at least one pair of edges lying parallel to one another and to an axis of said rotary valve.

4. A fuel injection system as defined in claim 1 characterized in that said main fuel port of said rotary valve is T-shaped with a T-stem thereof extending circumferentially of said valve and a T-head extending axially of said valve.

5. A fuel injection system as defined in claim 1 characterized in that said valve is operable in the engine idling position thereof to deliver approximately 80% of the fuel flow through said excess fuel venting port and approximately 20% through said main fuel port and to the engine intake manifold.

6. A fuel injection system as defined in claim 1 characterized in that said rotary valve is rotatable through an arc ranging between 80° and 90° in going from engine idling operation to full open throttle.

7. A fuel injection system as defined in claim 1 characterized in that both of said excess fuel venting port and said main fuel port in said rotary valve are T-shaped with the T-stem portions thereof extending circumferentially of said valve, and said venting port being in full or partial registry with said excess fuel venting passage through approximately a 23° rotary movement of said rotary volve depending on the rotary position thereof.

8. A fuel injection system as defined in claim 1 characterized in that said excess fuel venting port is fully open in the engine idling position and is partially closed when said valve is rotated through approximatley 15° to partially accelerate the engine to a steady speed at the starting line of the race

9. A fuel injection system as defined in claim 7 characterized in that the T-stem portion of said T-shaped main fuel port extends approximately 18° circumferentially of said valve, and the closed end of said T-stem portion being open approximately 3° in the engine idling position of said valve.

10. A fuel injection system as defined in claim 7 characterized in that a T-head portion of said T-shaped venting port has an arcuate width of approximately 8° circumferentially of said valve.

11. A fuel injection system as defined in claim 1 characterized in that said excess fuel venting port is a slot extending axially of said valve and having an arcuate width of approximately 9° in registry with said excess fuel outlet passage when said valve is in the engine idling position thereof.

12. A fuel injection system as defined in claim 11 characterized in that said main fuel port in said valve is T-shaped with only a minor portion of a T-head portion thereof in registry with said main fuel passage in the engine idling position of said valve.

13. A fuel injection system as defined in claim 12 characterized in that said butterfly throttle valve is open approximately 1.6° in the engine idling position thereof and is operable to supply 100% of engine acceleration requirements when first opened approximately 9° further.

14. A fuel injection system as defined in claim 12 characterized in that the remaining and major part of the T-head portion of said main fuel port is rotatable into registry with said fuel outlet passage during the opening of said valve toward the full open throttle position thereof thereby to maintain a high efficiency fuel/air ratio to the engine during the initial phase of acceleration.

15. A fuel injection system as defined in claim 4 characterized in that said fuel venting port and said main fuel (nozzle supply) port are T-shaped and have their respective T-stem proportions and their T-head portions parallel to one another.

16. A fuel injection system as defined in claim 15 characterized in that, when said metering valve member is positioned for engine idling, said venting port is positioned to vent to said fuel source approximately 80% of the fuel entering said metering valve member, and said main fuel port is positioned to pass approximately 20% of the fuel entering said metering valve member to the engine intake manifold.

17. A fuel injection system as defined in claim 16 characterized in that upon rotation of said metering valve member not in excess of about 9° from the idling position thereof said venting port is positioned to vent to said fuel source approximately 60% of the fuel entering said metering valve member, and is operable to pass to the engine intake manifold approximately 40% of the fuel entering said metering valve member.

18. A fuel injection system for use on a drag race engine of the type having an engine-driven positive displacement pump supplying pressurized fuel to an inlet of a fuel metering valve operatively connected to a throttle valve controlling air flow to an intake manifold via an engine-driven supercharger, said fuel metering valve being characterized in having:

a housing having an annular bore in communication with a fuel inlet, a non-circular outlet passage in communication with fuel injection nozzles discharging into said intake manifold, and a non-circular excess fuel passage in communication with a source of fuel via unrestricted valveless duct means;

a rotary valve in said bore operatively connected to spring-biased accelerator means and to said throttle valve;

said valve having a T-shaped main fuel port and a non-circular fuel venting port operatively associated with a respective one of said non-circular fuel outlet passages and effective to vent approximately 80% of the fuel to said fuel source and 20% of the fuel to said injection nozzles during engine idling, and effective to close said venting port thereafter to supply 100% of the fuel entering said T-shaped port to said nozzles after said valve has been rotated not in excess of about 9% from the engine idling position thereof during initial acceleration of said engine.

19. A fuel injection system as defined in claim 18 characterized in that said venting port is an elongated slot extending axially of said valve with the lateral edges thereof parallel to the lateral edges of a T-head portion of said T-shaped main fuel port, and said non-circular main fuel outlet passage having an edge parallel to an edge of the T-head portion of said T-shaped port and cooperable therewith to limit fuel flow to the engine during idling operation thereof.

20. A fuel injection system as defined in claim 18 characterized in that rotation of said valve about 9° from the engine idling position thereof is effective to open said throttle through 9° to admit 100% of air requirements for the fuel then flowing to the engine intake manifold from said main fuel to said fuel metering valve.

21. A fuel injection system as defined in claim 18 characterized in that said valve is rotatable from the engine idling position through an arc between 80° and 90° to the full open throttle position thereof.

22. A fuel injection system as defined in claim 18 characterized in that the T-head portion of said main fuel port is slightly larger than said venting port and remains open for a short interval after said venting port closes during the abrupt rotation of said valve from engine idling to the fuel open throttle position thereof thereby to support a highly efficient flow of fuel to the intake manifold during engine acceleration.

* * * * *